United States Patent [19]

Lyons, Sr.

[11] Patent Number: 4,729,453

[45] Date of Patent: Mar. 8, 1988

[54] PORTABLE SAFETY POST

[75] Inventor: Robert J. Lyons, Sr., Hamden, Conn.

[73] Assignee: The Bilco Company, New Haven, Conn.

[21] Appl. No.: 43,334

[22] Filed: Apr. 28, 1987

[51] Int. Cl.[4] ..... E06C 5/36; E06C 7/18

[52] U.S. Cl. ..... 182/106; 182/100

[58] Field of Search ..... 182/106, 178, 100, 189, 182/228, 220

[56] References Cited

U.S. PATENT DOCUMENTS

| | | | |
|---|---|---|---|
| 1,206,906 | 12/1916 | Persson | 182/189 |
| 1,582,017 | 4/1926 | Vetterlein | 182/220 |
| 2,010,588 | 8/1935 | Gooden | 182/106 |
| 2,641,401 | 6/1953 | James | 182/189 |
| 3,395,501 | 8/1968 | Davidson | 182/178 |
| 3,455,414 | 7/1969 | Higgins | 182/106 |
| 3,598,200 | 8/1971 | Thompson | 182/106 |
| 4,546,855 | 10/1985 | Lyons | 182/106 |

*Primary Examiner*—Reinaldo P. Machado
*Attorney, Agent, or Firm*—DeLio & Associates

[57] ABSTRACT

A safety post assembly for assisting entry to or exit from the upper portion of a wall having mounted thereon a series of rungs forming a ladder, the assembly comprising a tubular support sleeve; adjustable mounting means for securing the sleeve to the rungs in an upstanding position; an elongated extension rod having a tapered lower end portion for sliding insertion into the tubular sleeve and an opposite upper end portion adapted to extend above the upper portion of the structure and provide grasping means during the entry and exit; a projection extending outwardly from the extension rod, and adapted to rest against the upper end of the sleeve for limiting insertion of the rod lower end portion into the sleeve to a predetermined distance sufficient to support the weight of a person grasping the rod upper end portion during the entry and exit; and a step member extending transversely on opposite sides of the extension rod between the upper and lower end portions and positioned to provide a foothold in the vicinity of the upper portion of the structure during the entry and the exit, the transverse member including a flange on either side of the extension rod and bolt means passing through the extension rods and the flanges to secure the member to the rod. The extension rod is entirely directly removable from the sleeve by grasping the rod and urging the rod in an upward direction. The assembly further includes means to counterbalance the weight of the extension rod when the lower end of the rod is inserted in the support sleeve, the counterbalance means comprising a spring disposed within the sleeve, the spring having a first end portion secured to the sleeve and a second end portion biased into a wound coil, the spring second end portion being engagable by the rod lower end portion to unwind the coil as the rod is inserted to the predetermined distance, the spring offsetting a substantial portion of the weight of the extension rod when the rod is inserted into the sleeve.

24 Claims, 10 Drawing Figures

PORTABLE SAFETY POST

BACKGROUND OF THE INVENTION

This invention relates to a safety post assembly for assisting entry to or exit from the upper portion of a structure and, in particular, to a safety extension post removably secured to the upper end of a ladder in a manhole to provide grasping means during entry to or exit from the upper portion of the ladder.

There are a number of prior art devices which are directed to providing for increased safety in exiting from or entering to the upper portion of a ladder or other structure, especially fixed ladders having a hatchway at their upper end. In general, some of these devices provide a rail or auxiliary support so that the ladder user can grasp the rail and thus improve his or her balance and stability while using the ladder. Some prior art devices also essentially extend the useful reach of the ladder by providing a support means at the upper extremes of the ladder.

In U.S. Pat. No. 4,546,855, the disclosure of which is hereby incorporated by reference, there is disclosed and claimed a safety extension adapted to be mounted by various adjustable means to the upper rungs of a ladder, particularly the ladder inside of a manhole. The safety extension comprises a rod which is adjustable in a sleeve between extended and retracted positions. The rod is nonremovably secured in the sleeve which includes adjustable mounting means to accommodate ladders of different rung spacing and rung diameter. A coil spring counterbalance facilitates upward and downward movement of the rod.

While the extension rod of U.S. Pat. No. 4,546,855 provided a considerable improvement over the prior art, especially in connection with manhole ladders, it requires a somewhat expensive and complex assembly which must be completely supplied for each manhole ladder. In addition, the counterbalance assembly must be provided to accommodate the full weight of the post. Also, the safety extension provides no additional step for entry to or exit from the manhole ladder.

Bearing in mind these and other problems in the prior art, it is therefore an object of the present invention to provide a portable safety post extension assembly for assisting entry to or exit from the upper portion of a structure.

It is another object of the present invention to provide an effective safety post assembly which is less costly than those heretofore known.

It is a further object of the present invention to provide a safety post assembly which is of simple design, yet which facilitates use with various types of structures.

It is yet another object of the present invention to provide a safety post assembly which provides a foothold for facilitating entry to or exit from the upper portion of a structure.

It is a further object of the present invention to provide an improved safety post assembly which is easy to ship and transport for use with more than one strucuture.

SUMMARY OF THE INVENTION

These and other objects, which will be apparent to those skilled in the art, are achieved by the present invention which provides a safety post assembly for assisting entry to or exit from the upper portion of a structure comprising a tubular support sleeve; adjustable mounting means for securing the sleeve to the structure in an upstanding position; an elongated extension rod having a tapered lower end portion for sliding insertion into the tubular sleeve and an opposite upper end portion adapted to extend above the upper portion of the structure and provide grasping means during the entry and exit; and stop means for limiting insertion of the rod lower end portion into the sleeve to a predetermined distance sufficient to support the weight of a person grasping the rod upper end portion during the entry and exit. The extension rod is entirely directly removable from the sleeve by grasping the rod and urging the rod in an upward direction. A spring counterbalance assembly may be provided in the sleeve to offset a substantial portion of the weight of the extension rod when the rod is inserted into the sleeve. The spring has a first end portion secured to the sleeve and a second end portion biased into a wound coil, the second end portion being engagable by the rod lower end portion to unwind the coil as the rod is inserted to the predetermined distance. The safety post extension rod may include step means to provide a foothold in the vicinity of the upper portion of the structure during entry and exit.

DETAILED DESCRIPTION OF THE INVENTION

The improved safety post assembly of the present invention is intended for use at the upper portions of various types of structures, for examples walls or buildings, to assist entry to or exit from that structure upper portion.

While reference will be made herein to various directions, it is to be understood that such directions are for illustration and clarification purposes only and should not be construed as limiting the present invention. Like features of the present invention will be referred to by like numerals in the various figures of the drawings.

Figure 1:
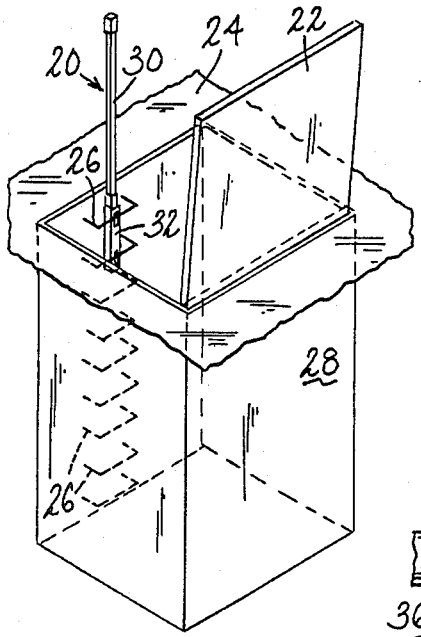
FIG. 1 is a perspective view of a preferred embodiment of the safety post assembly of the present invention illustrated in conjunction with a manhole, including a fixed ladder and cover, parts of the drawing being illustrated in phantom lines.

In FIG. 1 there is depicted the improved safety post assembly 20 mounted to the upper rungs of a ladder 26 which provides access to a manhole 28 having a moveable cover 22 thereover. Ladder 26 is shown mounted to the interior wall of manhole 28. Safety post assembly 20 facilitates the movement of a person between ground level 24 and ladder 26 by providing a grasp hold for the hands and arms of a person as he or she enters or exits the manhole 28.

Figure 2:
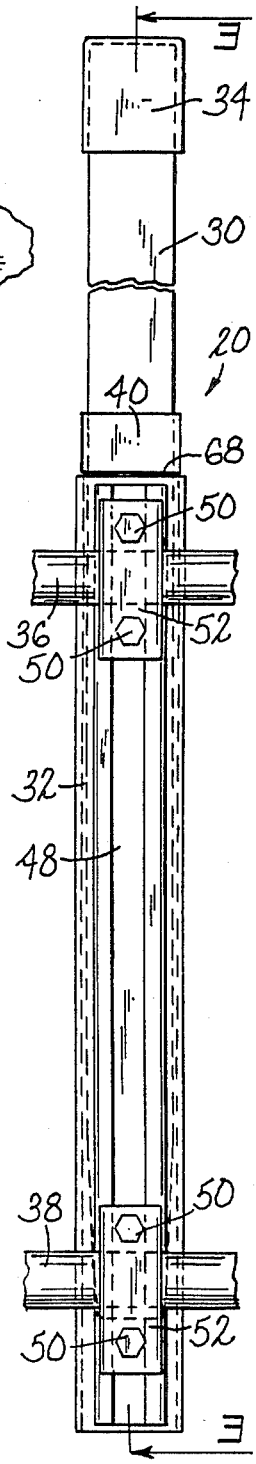
FIG. 2 is a front elevational view of the safety post assembly illustrated in FIG. 1.
Figure 3:
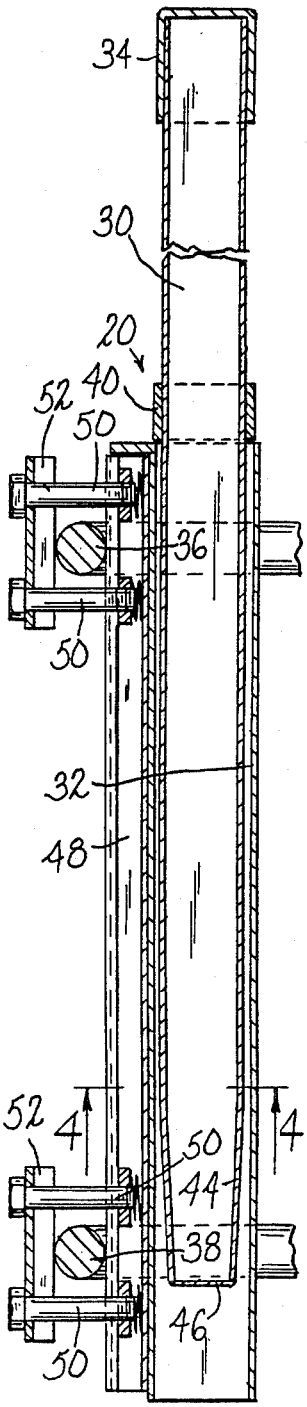
FIG. 3 is a side cross sectional view of the safety post assembly of FIG. 1.

In FIGS. 2 and 3 there is shown the safety post assembly 20 mounted to the upper rungs 36 and 38 of a ladder assembly such as that depicted in FIG. 1. While the present invention is particularly suitable for mounting on the rungs of a ladder, it is to be understood that it may be mounted to any rigid member on the upper portion of any of the structures on which the invention is to be used. Safety post assembly 20 includes an upstanding tubular support sleeve 32 made of steel or other rigid material which extends between the vertical distance spanning rungs 36 and 38. For attaching tubular sleeve 32 to rungs 36 and 38, there is provided a vertical channel 48 along the outside of support sleeve 32 and having outwardly extending legs. Bolts 50 are secured to slideable nuts inside channel 48 and are positioned above and below each rung 36, 38 to secure an opposite bolting strap 52 which enables support sleeve 32 to be mounted securely to each rung. The leg portions of bolting strap 52 may be positioned to face toward or away from the rung, as disclosed in the aforementioned U.S. Pat. No. 4,546,855, to accommodate rungs of different diameter. The adjustment of bolts 52 along vertical channel 48 accommodates any vertical spacing between rungs 36 and 38.

Figure 4:
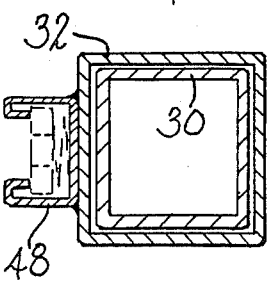
FIG. 4 is a top cross sectional view of the safety post assembly of FIG. 3 taken along lines 4—4.

As shown more clearly in FIG. 4, support sleeve 32 comprises a hollow steel tube of rectangular or square cross section which is adapted to slideably receive extension rod 30 nonrotatably therein. Extension rod 30 is of comparable size and cross section, and is also preferably made of steel or some other rigid material which provides suitable support for the weight of a person.

Turning back to FIGS. 2 and 3, vertically oriented support sleeve 32 includes a free upper open end 68 which is upwardly facing to receive extension rod 30. Upstanding extension rod 30 is removably disposed in sleeve 32 and includes a welded collar 40 about the exterior of an intermediate portion of its length to provide a projecting stop means to rest on sleeve end 68 and prevent further insertion of rod 30 into sleeve 32 beyond a predetermined distance. The lower portion 44 of rod 30 is tapered inwardly to facilitate insertion of the rod into the sleeve end 68. The upper end of extension rod 30 extends a sufficient distance upward from collar 40 so that grasping by a person's hand is facilitated. A protective cap 34 is disposed at the extreme upper end of extension rod 30. Optionally, a lifting lug may be provided at the top of extension rod 30, as disclosed in U.S. Pat. No. 4,546,855. The distance between the lower end of collar 40 and the lower end 46 of extension rod 30 should be sufficient to secure extension rod 30 against the force and full weight of a person grasping the upper end of the rod during entry and exit from the structure. Rod 30 may be removed from sleeve 32 by simply grasping the rod and urging it in an upward direction.

It is contemplated that with the present invention it will be necessary only to provide and secure the tubular sleeve 32 to each structure for which entry and exit assistance is desired. It is also contemplated that only those for whom such entry and exit is authorized, for example, repair or service workers, will be provided with the removable extension rod 30 for use with the tubular sleeve 32. By making the extension rod completely removable the rod 30 may be taken from the site once the repair work is completed, thereby discouraging unauthorized access to and from the structures, for example, manholes. Because only the tubular sleeve 32 need by affixed in each of the numerous manholes of a system, and because only the presumably far fewer number of service workers need be provided with extension rod 30, the present invention will be considerably cheaper and less costly to install, whill still providing considerable safety and ease of access to and from these manholes structures.

Figure 5:
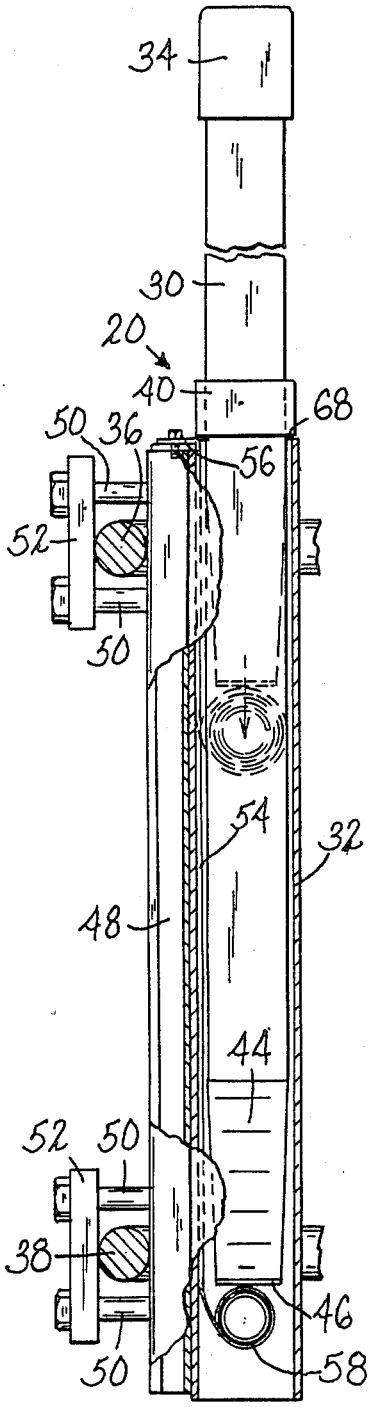
FIG. 5 is a side view, partially cut away, of a more preferred embodiment of the safety post assembly of FIG. 1 wherein there is shown a coiled spring counterbalance assembly.

In FIG. 5 there is shown an embodiment of the present invention wherein a counterbalance spring 54 is provided to facilitate insertion and removal of extension rod 30 from tubular sleeve 32. Spring 54 comprises a strip of spring steel or the like biased into a coil form. Upper end 56 of spring 54 is secured near the upper edge 68 of tubular support 32. The coil portion 58 of spring 54 extends downwardly into the interior of tubular support 32 and is shown wrapped in a counterclockwise manner. As the tapered end 44 of extension rod 30 is inserted into the upper end of sleeve 32, lower rod end 46 contacts spring coil 58 and unwinds coil 58 as the lower end of rod 30 is fully inserted its predetermined distance into sleeve 32. Spring 54 should be constructed such that it provides a upward biasing force sufficient to counterbalance at least a portion and, preferably, most of the weight of extension rod 30 while still allowing extension rod 30 to be fully seated in sleeve 32 by its own weight. Since extension rod 30 may be of considerable weight, counterbalancing spring 54 facilitates complete removal of rod 30 from sleeve 32 once access to the manhole is no longer required. This counterbalancing action is especially desirable since a person removing extension rod 30 must necessarily reach over the edge of the manhole opening.

Figure 7:
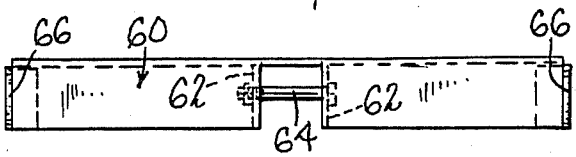
FIG. 7 is a top plan view of the foothold assembly depicted in FIG. 6.
Figure 8:
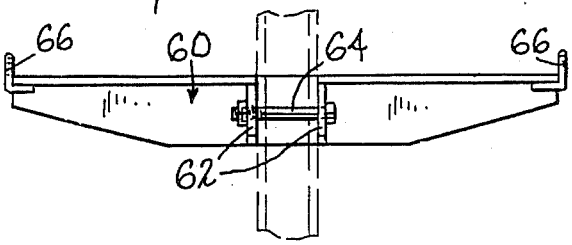
FIG. 8 is a front elevational view of the foothold assembly depicted in FIG. 6.
Figure 6:
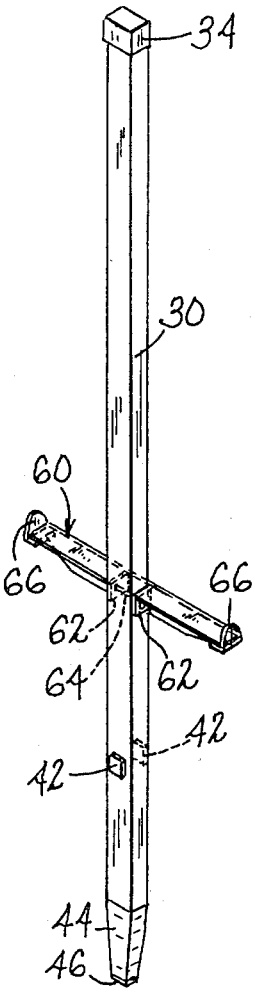
FIG. 6 is a perspective view of a more preferred embodiment of the safety post assembly of FIG. 1 wherein there is shown a foothold mounted on the safety post.

To further facilitate access to and from the upper portion of a structure, extension rod 30 is provided with step means which is preferably a foothold assembly 60 as shown in FIG. 6. Foothold assembly 60 comprises a rigid steel member removably secured transversely to extension rod 30 and is mounted above stop projections 42, which would normally rest at the upper edge 68 of sleeve 32, a sufficient distance so that an extra supporting step may be provided to the user for entry to or exit from the upper portion of the structure. As shown in FIGS. 6, 7 and 8, foothold assembly 60 includes flanges 62 which are positioned immediately adjacent to the outer surface of extension rod 30 and are provided with holes which match complimentary holes in the extension rod for insertion of a bolt or pin 64 to secure foothold assembly 60 to extension rod 30. Foothold assembly 60 extends horizontally outwardly on both sides of rod 30 in the vicinity of and preferably slight above the upper portion of the structure, and includes upturned ends 66 on each end to prevent a person's foot from slipping off.

By incorporation of foothold assembly 60 into extension rod 30, a person wishing to enter or exit from a structure, for example, the manhole of FIG. 1, may now be provided with an extra step near or above ground level so that the person may step onto the safety post assembly while swinging to or from the top of the manhole ladder. The upturned ends 66 of the foothold assembly 60 reduces the chance of the person's foot sliding off the end of the foothold, for example, under wet conditions, and provide an extra measure of safety.

Figure 9:
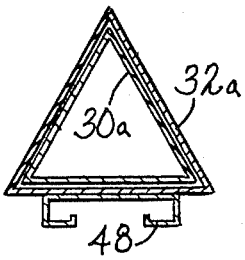
FIG. 9 is a top cross sectional view of a first alternate embodiment of the safety post assembly of the present invention.
Figure 10:
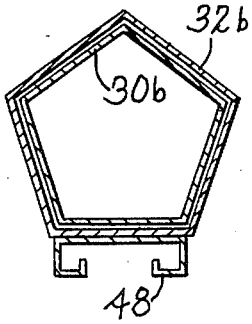
FIG. 10 is a top cross sectional view of a second alternate embodiment of the safety post assembly of the present invention.

In FIGS. 9 and 10 there are respectively shown complimentary triangular and pentagonal cross sectional shapes for sleeve 32 and extension rod 30. Such non-symmetrical shapes may be utilized, for example where it is particularly desirable that extension rod 30 be insertable to sleeve 32 in one orientation only.

Thus, it is seen that the present invention provides a simple, safe and facile method of providing access to or from the upper portions of structures, such as manholes, by providing for a removable extension rod. Use of the present invention may be restricted to only those persons authorized to have access to the particular structure. In addition, insertion and removal of the extension rod is facilitated by the counterbalance means illustrated. For added safety a foothold is provided for additional support during access to and from the particular structure. Shipping of the extension rod is further facilitated by the removable feature of the foothold assembly.

While this invention has been described with reference to specific embodiments, it will be recognized by those skilled in the art that variations are possible without departing from the spirit and scope of the invention and that it is intended to cover all changes and modifications of the invention disclosed herein for the purposes of illustration which do not constitute from the spirit and scope of the invention.

Having thus described the invention, what is claimed is:

1. A safety post assembly for assisting entry to or exit from the upper portion of a structure comprising:

a tubular support sleeve;

adjustable mounting means for securing said sleeve to said structure in an upstanding position;

an elongated extension rod having a tapered lower end portion for sliding insertion into said tubular sleeve and an opposite upper end portion adapted to extend above said upper portion of said structure and provide grasping means during said entry and exit;

stop means for limiting insertion of said rod lower end portion into said sleeve to a predetermined distance sufficient to support the weight of a person grasping said rod upper end portion during said entry and exit; and means to counterbalance a portion of the weight of said extension rod when said lower end of said rod is inserted in said support sleeve while allowing said rod to be fully seated in the support sleeve by the rod's own weight;

said extension rod being entirely directly removable from said sleeve by grasping said rod and urging said rod in an upward direction.

2. The assembly of claim 1 wherein said structure comprises a wall having mounted thereon a series of rungs forming a ladder, and wherein said sleeve mounting means is adapted to secure said sleeve to said rungs.

3. The assembly of claim 1 wherein said counterbalance means comprises a spring disposed within said sleeve, said spring having a first end portion secured to said sleeve and a second end portion biased into a wound coil, said spring second end portion being engagable by said rod lower end portion to unwind said coil as said rod is inserted to said predetermined distance, said spring being adapted to offset a substantial portion of said weight of said extension rod when said rod is inserted into said sleeve.

4. The assembly of claim 2 wherein said extension rod includes step means between said upper and lower end portions and positioned to provide a foothold in the vicinity of said upper portion of said structure during said entry and said exit, whereby a user is provided with an extra supporting step above the ladder rungs of said structure.

5. The assembly of claim 4 wherein said step means comprises a rigid member extending transversely on opposite sides of said extension rod.

6. The assembly of claim 5 wherein said transverse member has opposite upturned ends to prevent a foot from sliding off said member ends.

7. The assembly of claim 5 wherein said transverse member if removable from said extension rod.

8. The assembly of claim 1 wherein said stop means includes a projection extending outwardly from said extension rod, and adapted to rest against the upper end of said sleeve to limit insertion of said rod lower end portion at said predetermined distance.

9. A safety post assembly for assisting entry to or exit from the upper portion of a structure having mounted thereon a series of rungs forming a ladder comprising:

a tubular support sleeve;

adjustable mounting means for securing said sleeve to said structure in an upstanding position;

an elongated extension rod having a tapered lower end portion for sliding insertion into said tubular sleeve and an opposite upper end portion adapted to extend above said upper portion of said structure and provide grasping means during said entry and exit;

stop means for limiting insertion of said rod lower end portion into said sleeve to a predetermined distance sufficient to support the weight of a person grasping said rod upper end portion during said entry and exit;

means to counterbalance a portion of the weight of said extension rod when said lower end of said rod is inserted in said support sleeve while allowing said rod to be fully seated in the support sleeve by the rod's own weight; and step means between said upper and lower end portions and positioned to provide a foothold in the vicinity of said upper portion of said structure during said entry and said exit, whereby a user is provided with an extra supporting step above the ladder rungs of said structure;

said extension rod being entirely directly removable from said sleeve by grasping said rod and urging said rod in an upward direction.

10. The assembly of claim 9 wherein said counterbalance means comprises a spring disposed within said sleeve, said spring having a first end portion secured to said sleeve and a second end portion biased into a wound coil, said spring second end portion being engagable by said rod lower end portion to unwind said coil as said rod is inserted to said predetermined distance, said spring offsetting a substantial portion of said weight of said extension rod when said rod is inserted into said sleeve.

11. The assembly of claim 10 wherein said step means comprises a removable rigid member extending transversely on opposite sides of said extension rod.

12. The assembly of claim 11 wherein said transverse member has opposite upturned ends to prevent a foot from sliding off said member ends.

13. The assembly of claim 12 wherein said stop means includes a projection extending outwardly from said extension rod, and adapted to rest against the upper end of said sleeve to limit insertion of said rod lower end portion of said predetermined distance.

14. The assembly of claim 13 wherein said structure comprises a wall having mounted thereon series of rungs forming a ladder, and wherein said sleeve mounting means is adapted to secure said sleeve to said rungs.

15. A safety post assembly for assisting entry to or exit from the upper portion of a wall having mounted thereon a series of rungs forming a ladder, said assembly comprising:

a tubular support sleeve;

adjustable mounting means for securing said sleeve to said rungs in an upstanding position;

an elongated extension rod having a tapered lower end portion for sliding insertion into said tubular sleeve and an opposite upper end portion adapted to extend above said upper portion of said structure and provide grasping means during said entry and exit;

a projection extending outwardly from said extension rod, and adapted to rest against the upper end of said sleeve for limiting insertion of said rod lower end portion into said sleeve to a predetermined distance sufficient to support the weight of a person grasping said rod upper end portion during said entry and exit; and a removable step member extending transversely on opposite sides of said extension rod between said upper and lower end portions and positioned to provide a foothold in the vicinity of said upper portion of said structure during said entry and said exit whereby a user is provided with an extra supporting step above the ladder rungs of said structure, said transverse member including a flange on either side of said extension rod and bolt means passing through said extension rods and said flanges to secure said member to said rod, said extension rod being entirely directly removable from said sleeve by grasping said rod and urging said rod in an upward direction.

16. The assembly of claim 15 wherein said transverse member has opposite upturned ends to prevent a foot from sliding off said member ends.

17. The assembly of claim 16 further including means to counterbalance the weight of said extension rod when said lower end of said rod is inserted in said support sleeve, said counterbalance means comprising a spring disposed within said sleeve, said spring having a first end portion secured to said sleeve and a second end portion biased into a wound coil, said spring second end portion being engagable by said rod lower end portion to unwind said coil as said rod is inserted to said predetermined distance, said spring offsetting a substantial portion of said weight of said extension rod when said rod is inserted into said sleeve while allowing said rod to be fully seated in the support sleeve by the rod's own weight.

18. A safety post assembly for assisting entry to or exit from the upper portion of a structure having mounted thereon a series of rungs forming a ladder comprising:

a tubular support sleeve;

adjustable mounting means for securing said sleeve to said structure in an upstanding position;

an elongated extension rod having a tapered lower end portion for sliding insertion into said tubular sleeve and an opposite upper end portion adapted to extend above said upper portion of said structure and provide grasping means during said entry and exit;

stop means for limiting insertion of said rod lower end portion into said sleeve to a predetermined distance sufficient to support the weight of a person grasping said rod upper end portion during said entry and exit; and step means between said upper and lower end portion and positioned to provide a foothold in the vicinity of said upper portion of said structure during said entry and said exit, whereby a user is provided with an extra supporting step above the ladder rungs of said structure, said extension rod being entirely directly removable from said sleeve by grasping said rod and urging said rod in an upward direction.

19. The assembly of claim 18 wherein said structure comprises a wall having mounted thereon a series of rungs forming a ladder, and wherein said sleeve mounting means is adapted to secure said sleeve to said rungs.

20. The assembly of claim 19 further including means to counterbalance a portion of the weight of said extension rod when said lower end of said rod is inserted in said support sleeve while allowing said rod to be fully seated in the support sleeve by the rod's own weight.

21. The assembly of claim 20 wherein said counterbalance means comprises a spring disposed within said sleeve, said spring having a first end portion secured to said sleeve and a second end portion biased into a wound coil, said spring second end portion being engagable by said rod lower end portion to unwind said coil as said rod is inserted to said predetermined distance, said spring being adapted to offset a substantial portion of said weight of said extension rod when said rod is inserted into said sleeve.

22. The assembly of claim 18 wherein said step means comprises a rigid member extending transversely on opposite sides of said extension rod and includes opposite upturned ends to prevent a foot from sliding off said member ends.

23. The assembly of claim 22 wherein said transverse member is removable from said extension rod.

24. The assembly of claim 23 wherein said stop means includes a projection extending outwardly from said extension rod, and adapted to rest against the upper end of said sleeve to limit insertion of said rod lower end portion at said predetermined distance.

* * * * *

UNITED STATES PATENT AND TRADEMARK OFFICE

CERTIFICATE OF CORRECTION

PATENT NO. : 4,729,453

DATED : Mar. 8, 1988

INVENTOR(S) : Robert J. Lyons, Sr.

It is certified that error appears in the above-identified patent and that said Letters Patent are hereby corrected as shown below:

In the Description:

Column 4, line 17, delete "whill" and substitute -- while --.

In the Claims:

Column 6, line 21, delete "if" and substitute -- is --.

Signed and Sealed this

Twenty-third Day of August, 1988

*Attest:*

DONALD J. QUIGG

*Attesting Officer*

*Commissioner of Patents and Trademarks*